US008387810B2

(12) United States Patent
Livingston et al.

(10) Patent No.: US 8,387,810 B2
(45) **Date of Patent: *Mar. 5, 2013**

(54) PIERCEABLE CAP HAVING PIERCING EXTENSIONS FOR A SAMPLE CONTAINER

(75) Inventors: Dwight Livingston, Fallston, MD (US); Dustin Diemert, Baltimore, MD (US); Ammon David Lentz, York, PA (US)

(73) Assignee: Becton, Dickinson and Company, Franklin Lakes, NJ (US)

( * ) Notice: Subject to any disclaimer, the term of this patent is extended or adjusted under 35 U.S.C. 154(b) by 1658 days.

This patent is subject to a terminal disclaimer.

(21) Appl. No.: 11/785,144

(22) Filed: Apr. 16, 2007

(65) Prior Publication Data

US 2008/0251489 A1 Oct. 16, 2008

(51) Int. Cl.

| | |
|---|---|
| ***B65D 47/36*** | (2006.01) |
| ***B65D 47/38*** | (2006.01) |
| *B01L 3/00* | (2006.01) |
| *A61J 1/05* | (2006.01) |

(52) U.S. Cl. ..... 215/250; 215/247; 215/249; 215/253; 220/266; 604/415; 422/400; 422/570

(58) Field of Classification Search ..... 215/230, 215/250, 247, 249, 253, 248; 220/266, 229, 220/258.3, 258.4, 258.5; 604/415; 422/568, 422/570

See application file for complete search history.

(56) References Cited

U.S. PATENT DOCUMENTS

| | | | | |
|---|---|---|---|---|
| 1,413,703 | A | 4/1922 | Biehn | |
| 3,460,702 | A | 8/1969 | Andrews | |
| 4,259,956 | A * | 4/1981 | Ogle | 604/415 |
| 4,418,827 | A | 12/1983 | Butterfield | |
| 4,465,200 | A | 8/1984 | Percarpio | |
| 4,515,752 | A | 5/1985 | Miramanda | |
| 4,576,185 | A | 3/1986 | Proud et al. | |
| 4,582,207 | A | 4/1986 | Howard et al. | |

(Continued)

FOREIGN PATENT DOCUMENTS

| | | |
|---|---|---|
| AU | 4846800 | 12/2000 |
| CA | 2373572 | 11/2000 |

(Continued)

OTHER PUBLICATIONS

International Search Report, PCT/US2008/60349, dated Jun. 9, 2009.

(Continued)

*Primary Examiner* — Robin Hylton
(74) *Attorney, Agent, or Firm* — Lerner, David, Littenberg, Krumholz & Mentlik, LLP

(57) ABSTRACT

A pierceable cap may be used for containing sample specimens during storage and transport. The pierceable cap may prevent unwanted escape of sample specimen before transfer with a transfer device. The pierceable cap may fit over a vessel. An access port in the pierceable cap may allow passage of a tip of a transfer device though the pierceable cap. A frangible layer may be disposed across the access port. One or more extensions proximate to the frangible layer may be coupled to the pierceable cap by coupling regions or other similar devices. The one or more extension may rotate around the one or more coupling regions during insertion of the transfer device. The movement of the one or more extensions may pierce the frangible layer to create airways and allow air to escape from a vessel at a reduced velocity.

29 Claims, 5 Drawing Sheets

U.S. PATENT DOCUMENTS 4,600,112 A 7/1986 Shillington et al.
4,617,941 A 10/1986 Ichikawa et al.
4,664,274 A 5/1987 Konrad et al.
4,665,959 A 5/1987 Takagi
4,673,393 A 6/1987 Suzuki et al.
4,682,703 A 7/1987 Kasai et al.
4,685,917 A 8/1987 Baldini et al.
4,697,717 A 10/1987 Grippi
4,732,850 A 3/1988 Brown et al.
4,774,963 A 10/1988 Ichikawa et al.
4,811,856 A 3/1989 Fischman
4,815,618 A 3/1989 Gach
4,886,177 A 12/1989 Foster
4,892,222 A 1/1990 Schmidt et al.
4,898,293 A 2/1990 Morel
4,920,976 A 5/1990 Calzi et al.
4,957,637 A 9/1990 Cornell
4,995,521 A 2/1991 von Schuckmann
D315,680 S 3/1991 Baxter
5,024,327 A 6/1991 Shillington
5,033,476 A 7/1991 Kasai
5,036,992 A 8/1991 Mouchawar et al.
5,053,134 A 10/1991 Luderer et al.
5,061,263 A 10/1991 Yamazaki et al.
5,071,017 A 12/1991 Stull
5,084,393 A 1/1992 Rogalsky
5,100,010 A 3/1992 Waters
5,111,946 A 5/1992 Glanz
5,131,777 A 7/1992 Kimura et al.
5,152,277 A 10/1992 Honda et al.
5,165,560 A 11/1992 Ennis, III et al.
5,188,620 A 2/1993 Jepson et al.
5,201,794 A 4/1993 Kasai et al.
5,202,093 A 4/1993 Cloyd
5,275,299 A 1/1994 Konrad et al.
5,279,606 A 1/1994 Haber et al.
5,294,011 A 3/1994 Konrad et al.
5,297,599 A 3/1994 Bucheli et al.
5,306,270 A 4/1994 Macartney et al.
5,308,506 A 5/1994 McEwen et al.
5,326,534 A 7/1994 Yamazaki et al.
5,370,252 A 12/1994 Parsons et al.
5,395,365 A 3/1995 Weiler et al.
D357,985 S 5/1995 Burns
5,433,716 A 7/1995 Leopardi et al.
5,494,170 A 2/1996 Burns
5,501,676 A 3/1996 Niedospial et al.
5,514,339 A 5/1996 Leopardi et al.
5,522,518 A 6/1996 Konrad et al.
5,540,890 A 7/1996 Clark et al.
5,566,859 A 10/1996 Willis et al.
5,595,907 A 1/1997 Kayal et al.
5,611,792 A 3/1997 Gustafsson
5,627,071 A 5/1997 Triva et al.
5,632,396 A 5/1997 Burns
5,637,099 A 6/1997 Durdin et al.
5,658,531 A 8/1997 Cope et al.
5,738,920 A 4/1998 Knors
5,772,652 A 6/1998 Zielinski
5,779,074 A 7/1998 Burns
5,874,048 A 2/1999 Seto et al.
5,915,577 A 6/1999 Levine
5,924,584 A 7/1999 Hellstrom et al.
5,992,660 A 11/1999 Miura et al.
6,001,087 A 12/1999 Zurcher
6,006,931 A 12/1999 Sarstedt et al.
6,012,596 A * 1/2000 Oglesbee et al. ..... 215/261
6,024,235 A 2/2000 Schwab
6,030,582 A 2/2000 Levy
6,054,099 A 4/2000 Levy
6,056,135 A 5/2000 Widman
6,068,150 A 5/2000 Mitchell et al.
6,126,903 A 10/2000 Preston et al.
6,145,688 A 11/2000 Smith
6,170,693 B1 1/2001 Goto et al.
6,234,335 B1 5/2001 Gee et al.
6,255,101 B1 7/2001 Rousseau et al.
6,274,087 B1 8/2001 Preston et al.
6,277,331 B1 8/2001 Konrad et al.
6,286,698 B2 9/2001 Hague et al.
6,361,744 B1 3/2002 Levy
6,375,022 B1 4/2002 Zurcher et al.
D457,247 S 5/2002 Iheme et al.
6,402,407 B1 6/2002 Goldstein
6,406,671 B1 6/2002 DiCesare et al.
6,426,046 B1 7/2002 Cassells et al.
6,475,774 B1 11/2002 Gupta
6,517,782 B1 2/2003 Horner et al.
6,517,783 B2 2/2003 Horner et al.
6,562,300 B2 5/2003 Rosen et al.
6,607,685 B2 8/2003 Naritomi et al.
6,617,170 B2 9/2003 Augello et al.
6,627,156 B1 9/2003 Goodale et al.
6,662,957 B2 12/2003 Zurcher et al.
6,716,396 B1 4/2004 Anderson et al.
6,723,289 B2 4/2004 Iheme et al.
6,752,965 B2 6/2004 Levy
6,806,094 B2 10/2004 Anderson et al.
6,837,954 B2 1/2005 Carano
6,893,612 B2 5/2005 Kacian et al.
6,959,615 B2 11/2005 Gamble
6,994,699 B2 2/2006 Houwaert et al.
7,097,057 B2 8/2006 Classens et al.
7,153,477 B2 12/2006 DiCesare et al.
7,188,734 B2 3/2007 Konrad
2002/0090736 A1 7/2002 Ulin
2002/0127147 A1 9/2002 Kacian et al.
2002/0131902 A1 9/2002 Levy
2002/0132367 A1 9/2002 Miller et al.
2003/0017084 A1 1/2003 Dale et al.
2003/0052074 A1 3/2003 Chang et al.
2003/0053938 A1 3/2003 Szeles
2003/0155321 A1 8/2003 Bauer et al.
2003/0207463 A1 11/2003 Iheme et al.
2003/0215365 A1 11/2003 Sevigny et al.
2004/0013575 A1 1/2004 Stevens et al.
2004/0067169 A1 4/2004 Krause
2004/0076546 A1 4/2004 Bissett
2004/0091401 A1 5/2004 Golabek et al.
2004/0105786 A1 6/2004 Anderson et al.
2004/0150221 A1* 8/2004 Brown ..... 283/114
2004/0151634 A1 8/2004 Anderson et al.
2004/0152205 A1 8/2004 Anderson et al.
2005/0059161 A1 3/2005 Anderson et al.
2005/0079633 A1 4/2005 Kacian et al.
2005/0281713 A1 12/2005 Hampsch et al.
2006/0057738 A1 3/2006 Hall
2006/0263266 A1 11/2006 DiCesare et al.
2007/0034592 A1 2/2007 Pavlovic et al.

FOREIGN PATENT DOCUMENTS

EP 454493 10/1991
EP 513901 11/1992
EP 1183104 3/2002
EP 1495811 A2 1/2005
JP 7051253 2/1995
JP 8103433 4/1996
JP 2002-544076 12/2002
WO WO-9945360 9/1999
WO WO-0069389 11/2000
WO 2006108079 A1 10/2006

OTHER PUBLICATIONS

Supplementary European Search Report, EP 08745871, dated Aug. 17, 2010.

European Search Report for Application No. EP 11191354 dated Feb. 13, 2012.

* cited by examiner

PIERCEABLE CAP HAVING PIERCING EXTENSIONS FOR A SAMPLE CONTAINER

BACKGROUND OF THE INVENTION

Combinations of caps and vessels are commonly used for receiving and storing specimens. In particular, biological and chemical specimens may be analyzed to determine the existence of a particular biological or chemical agent. Types of biological specimens commonly collected and delivered to clinical laboratories for analysis may include blood, urine, sputum, saliva, pus, mucous, cerebrospinal fluid and others. Since these specimen-types may contain pathogenic organisms or other harmful compositions, it is important to ensure that vessels are substantially leak-proof during use and transport. Substantially leak-proof vessels are particularly critical in cases where a clinical laboratory and a collection facility are separate.

To prevent leakage from the vessels, caps are typically screwed, snapped or otherwise frictionally fitted onto the vessel, forming an essentially leak-proof seal between the cap and the vessel. In addition to preventing leakage of the specimen, a substantially leak proof seal formed between the cap and the vessel may reduce exposure of the specimen to potentially contaminating influences from the surrounding environment. A leak-proof seal may prevent introduction of contaminants that could alter the qualitative or quantitative results of an assay.

While a substantially leak-proof seal may prevent specimen seepage during transport, physical removal of the cap from the vessel prior to specimen analysis presents another opportunity for contamination. When removing the cap, any material that may have collected on the under-side of the cap during transport may come into contact with a user or equipment, possibly exposing the user to harmful pathogens present in the sample. If a film or bubbles form around the mouth of the vessel during transport, the film or bubbles may burst when the cap is removed from the vessel, thereby disseminating specimen into the environment. It is also possible that specimen residue from one vessel, which may have transferred to the gloved hand of a user, will come into contact with specimen from another vessel through routine or careless removal of the caps. Another risk is the potential for creating a contaminating aerosol when the cap and the vessel are physically separated from one another, possibly leading to false positives or exaggerated results in other specimens being simultaneously or subsequently assayed in the same general work area through cross-contamination.

Concerns with cross-contamination are especially acute when the assay being performed involves nucleic acid detection and an amplification procedure, such as the well known polymerase chain reaction (PCR) or a transcription based amplification system (TAS), such as transcription-mediated amplification (TMA) or strand displacement amplification (SDA). Since amplification is intended to enhance assay sensitivity by increasing the quantity of targeted nucleic acid sequences present in a specimen, transferring even a minute amount of specimen from another container, or target nucleic acid from a positive control sample, to an otherwise negative specimen could result in a false-positive result.

A pierceable cap may relieve the labor of removing screw caps prior to testing, which in the case of a high throughput instruments, may be considerable. A pierceable cap may minimize the potential for creating contaminating specimen aerosols and may limit direct contact between specimens and humans or the environment. Certain caps with only a frangible layer, such as foil, covering the vessel opening may cause contamination by jetting droplets of the contents of the vessel into the surrounding environment when pierced. When a sealed vessel is penetrated by a transfer device, the volume of space occupied by a fluid transfer device will displace an equivalent volume of air from within the collection device. The air displacement may release portions of the sample into the surrounding air via an aerosol or bubbles. It would be desirable to have a cap that permits air to be transferred out of the vessel in a manner that reduces or eliminates the creation of potentially harmful or contaminating aerosols or bubbles.

Other existing systems have used absorptive penetrable materials above a frangible layer to contain any possible contamination, but the means for applying and retaining this material adds cost. In other systems, caps may use precut elastomers for a pierceable seal, but these caps may tend to leak. Other designs with valve type seals have been attempted, but the valve type seals may cause problems with dispense accuracy.

Ideally, a cap may be used in both manual and automated applications, and would be suited for use with pipette tips made of a plastic material.

Generally, needs exist for improved apparatus and methods for sealing vessels with caps during transport, insertion of a transfer device, or transfer of samples.

SUMMARY OF THE INVENTION

Embodiments of the present invention solve some of the problems and/or overcome many of the drawbacks and disadvantages of the prior art by providing an apparatus and method for sealing vessels with pierceable caps.

Certain embodiments of the invention accomplish this by providing a pierceable cap apparatus including a shell, an access port in the shell for allowing passage of at least part of a transfer device through the access port, wherein the transfer device transfers a sample specimen, a frangible layer disposed across the access port for preventing transfer of the sample specimen through the access port prior to insertion of the at least part of the transfer device, one or more extensions proximate to the frangible layer, wherein the one or more extensions are coupled to the shell at one or more coupling regions, and wherein the one or more extensions rotate around the one or more coupling regions and pierce the frangible layer upon application of pressure from the transfer device.

In embodiments of the present invention, the pierceable cap may be coupled to a vessel by complementary screw threads or complementary ridges and grooves. The one or more coupling regions may be living coupling regions. In embodiments of the present invention, the pierceable cap may be coated for visually indicating whether the cap is pierced or not pierced.

In embodiments of the present invention the frangible layer may be a diaphragm where the diaphragm is thinner closest to the location of the piercing, the diaphragm is thickest at an outer perimeter for creating a gasket at the outer perimeter, and/or the diaphragm is symmetrical radially and top to bottom.

In some embodiments of the present invention the frangible layer may be foil and the foil may be secured to the cap. An o-ring may be present for sealing the pierceable cap to a vessel.

In embodiments of the present invention the frangible layer may be conical with the point of the cone facing the base of the shell and/or the one or more extensions may be initially disposed in a conical configuration complementary to the frangible layer. Embodiments of the present invention may include a unitary construction of the frangible layer and the one or more extensions.

In embodiments of the present invention the frangible layer may include pre-formed scoring. In embodiments of the present invention the frangible layer may be permeable to gases or may have low gas permeability.

Embodiments of the pierceable cap may also include an exterior recess within the access port and between a top of the shell and the one or more extensions, a peripheral groove for securing the frangible layer within shell, and/or a gasket for securing the frangible layer within the shell and creating a seal between the pierceable cap and a vessel.

In embodiments of the present invention the one or more extensions may be arranged in a star pattern, arranged in opposing pairs, and/or each have a pointed end opposite the one or more coupling regions. The one or more extensions may be formed from pre-formed scoring in the pierceable cap. In embodiments of the present invention, the one or more extensions may be positioned for directing a transfer device to a desired position within a vessel.

In embodiments of the present invention the movement of the one or more extensions creates airways for allowing air to move from through the access port.

In alternative embodiments, a pierceable cap may include a shell, an access port through the shell, one or more extensions coupled to walls of the access port by one or more coupling regions, a frangible layer within the access port proximate to the one or more extensions.

Embodiments of the present invention may include a method of piercing a cap including providing a cap, wherein the cap comprises a shell, an access port in the shell for allowing passage of at least part of a transfer device through the access port, wherein the transfer device transfers a sample specimen, a frangible layer disposed across the access port for preventing transfer of the sample specimen through the access port prior to insertion of the at least part of the transfer device, one or more extensions proximate to the frangible layer, wherein the one or more extensions are coupled to the shell at one or more coupling regions, and wherein the one or more extensions rotate around the one or more coupling regions and pierce the frangible layer upon application of pressure from the transfer device, inserting a transfer device into the access port, applying pressure to the one or more extensions with the transfer device wherein the one or more extensions rotate around the one or more coupling regions to contact and breach the frangible layer, and further inserting the transfer device through the access port. The method may also include coupling the cap to a vessel.

Additional features, advantages, and embodiments of the invention are set forth or apparent from consideration of the following detailed description, drawings and claims. Moreover, it is to be understood that both the foregoing summary of the invention and the following detailed description are exemplary and intended to provide further explanation without limiting the scope of the invention as claimed.

BRIEF DESCRIPTION OF THE INVENTION

The accompanying drawings, which are included to provide a further understanding of the invention and are incorporated in and constitute a part of this specification, illustrate preferred embodiments of the invention and together with the detailed description serve to explain the principles of the invention. In the drawings.

DETAILED DESCRIPTION

Figure 1B:
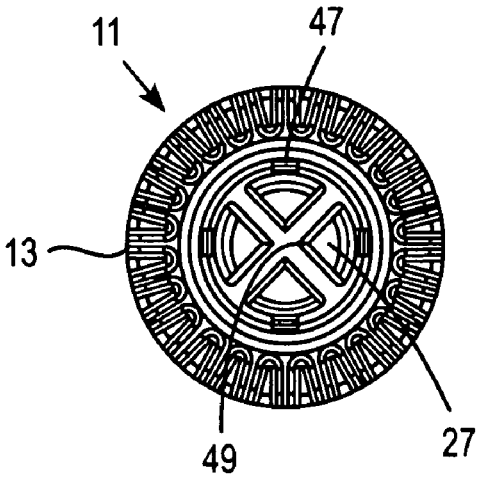
FIG. 1B is a top view of the pierceable cap of FIG. 1A
Figure 1A:
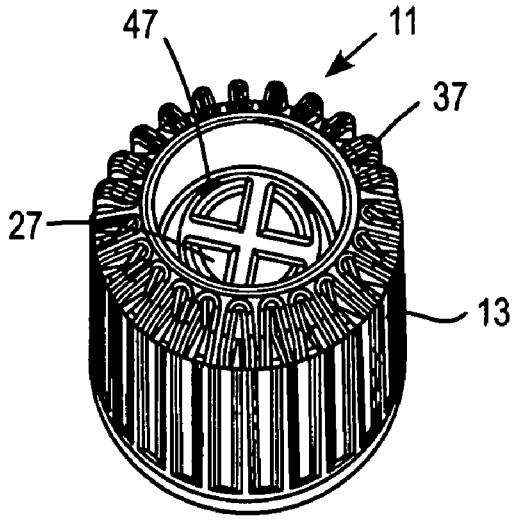
FIG. 1A is a perspective view of a pierceable cap with a diaphragm frangible layer.
Figure 1C:
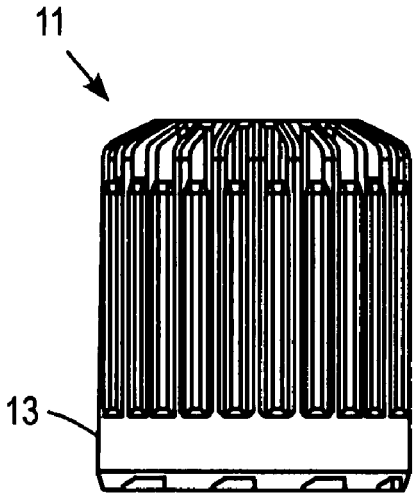
FIG. 1C is a side view of the pierceable cap of FIG. 1A.
Figure 1D:
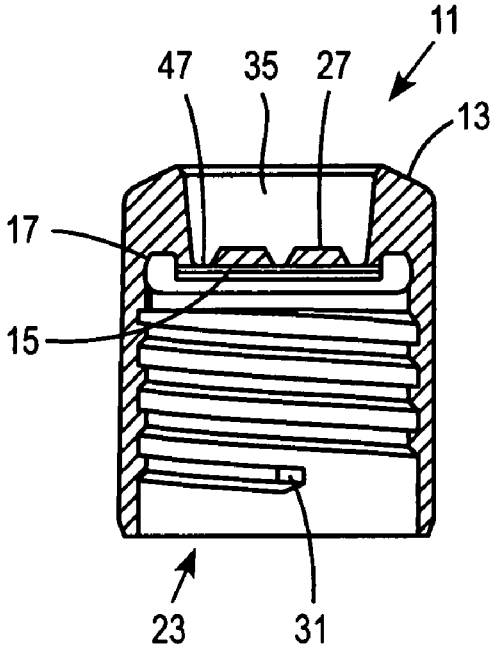
FIG. 1D is a cross sectional view of the pierceable cap of FIG. 1A.
Figure 1E:
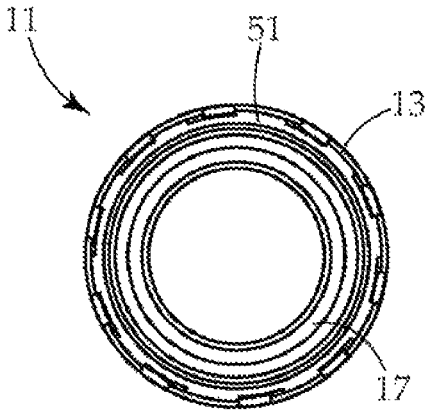
FIG. 1E is a bottom view as molded of the pierceable cap of FIG. 1A.
Figure 1F:
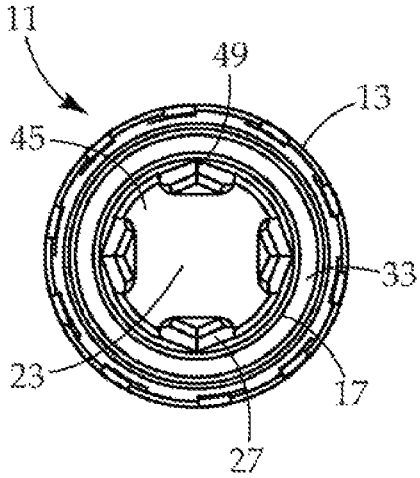
FIG. 1F is a bottom view of the pierceable cap of FIG. 1A pierced with the diaphragm not shown.
Figure 1G:
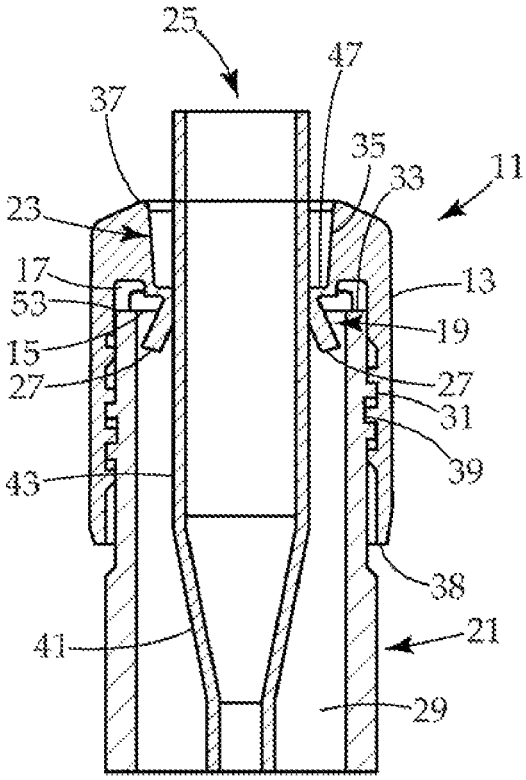
FIG. 1G is a cross sectional view of the pierceable cap of FIG. 1A coupled to a vessel with a pipette tip inserted through the cap.

Some embodiments of the invention are discussed in detail below. While specific example embodiments may be discussed, it should be understood that this is done for illustration purposes only. A person skilled in the relevant art will recognize that other components and configurations may be used without parting from the spirit and scope of the invention.

Embodiments of the present invention may include a pierceable cap for closing a vessel containing a sample specimen. The sample specimen may include diluents for transport and testing of the sample specimen. A transfer device, such as, but not limited to, a pipette, may be used to transfer a precise amount of sample from the vessel to testing equipment. A pipette tip may be used to pierce the pierceable cap. A pipette tip is preferably plastic, but may be made of any other suitable material. Scoring the top of the vessel can permit easier piercing. The sample specimen may be a liquid patient sample or any other suitable specimen in need of analysis.

A pierceable cap of the present invention may be combined with a vessel to receive and store sample specimens for subsequent analysis, including analysis with nucleic acid-based assays or immunoassays diagnostic for a particular pathogenic organism. When the sample specimen is a biological fluid, the sample specimen may be, for example, blood, urine, saliva, sputum, mucous or other bodily secretion, pus, amniotic fluid, cerebrospinal fluid or seminal fluid. However, the present invention also contemplates materials other than these specific biological fluids, including, but not limited to, water, chemicals and assay reagents, as well as solid substances which can be dissolved in whole or in part in a fluid milieu (e.g., tissue specimens, tissue culture cells, stool, environmental samples, food products, powders, particles and granules). Vessels used with the pierceable cap of the present invention are preferably capable of forming a substantially leak-proof seal with the pierceable cap and can be of any shape or composition, provided the vessel is shaped to receive and retain the material of interest (e.g., fluid specimen or assay reagents). Where the vessel contains a specimen to be assayed, it is important that the composition of the vessel be essentially inert so that it does not significantly interfere with the performance or results of an assay.

Embodiments of the present invention may lend themselves to sterile treatment of cell types contained in the vessel. In this manner, large numbers of cell cultures may be screened and maintained automatically. In situations where a cell culture is intended, a leak-proof seal is preferably of the type that permits gases to be exchanged across the membrane or seal. In other situations, where the vessels are pre-filled with transport media, stability of the media may be essential. The membrane or seal, therefore, may have very low permeability.

FIGS. 1A-1G show an embodiment of a pierceable cap 11. The pierceable cap 11 may include a shell 13, a frangible layer 15, and, optionally, a gasket 17.

The shell 13 may be generally cylindrical in shape or any other shape suitable for covering an opening 19 of a vessel 21. The shell 13 is preferably made of plastic resin, but may be made of any suitable material. The shell 13 may be molded by injection molding or other similar procedures. Based on the guidance provided herein, those skilled in the will be able to select a resin or mixture of resins having hardness and penetration characteristics which are suitable for a particular application, without having to engage in anything more than routine experimentation. Additionally, skilled artisans will realize that the range of acceptable cap resins will also depend on the nature of the resin or other material used to form the vessel 21, since the properties of the resins used to form these two components will affect how well the cap 11 and vessel 21 can form a leak proof seal and the ease with which the cap can be securely screwed onto the vessel. To modify the rigidity and penetrability of a cap, those skilled in the art will appreciate that the molded material may be treated, for example, by heating, irradiating or quenching. The shell 13 may have ridges or grooves to facilitate coupling of the cap 11 to a vessel 21.

The cap 11 is may be injection molded as a unitary piece using procedures well-known to those skilled in the art of injection molding, including a multi-gate process for facilitating uniform resin flow into the cap cavity used to form the shape of the cap.

The vessel 21 is may be a test tube, but may be any other suitable container for holding a sample specimen.

The frangible layer 15 may be a layer of material located within an access port 23. For the purposes of the present invention, "frangible" means pierceable or tearable. Preferably, the access port 23 is an opening through the shell 13 from a top end 37 of the shell 13 to an opposite, bottom end 38 of the shell 13. If the shell 13 is roughly cylindrical, then the access port 23 may pass through the end of the roughly cylindrical shell 13. The access port 23 may also be roughly cylindrical and may be concentric with a roughly cylindrical shell 13.

Figure 2A:
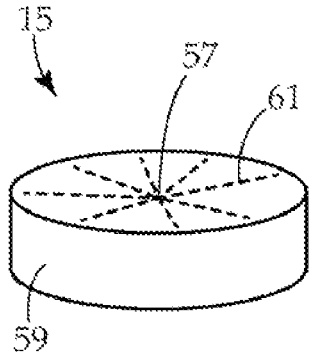
FIG. 2A is a perspective view of a frangible layer diaphragm.
Figure 2B:
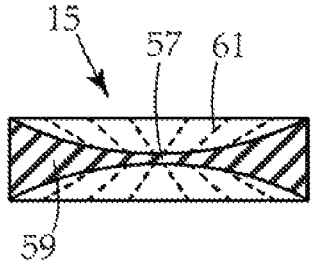
FIG. 2B is a cross sectional view of the frangible layer of FIG. 2A.
Figure 3B:
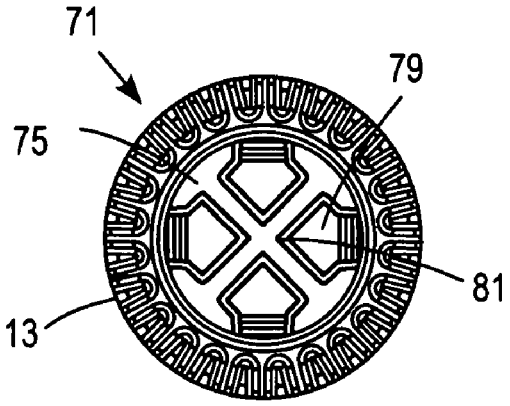
FIG. 3B is a top view of the pierceable cap of FIG. 3A.
Figure 3A:
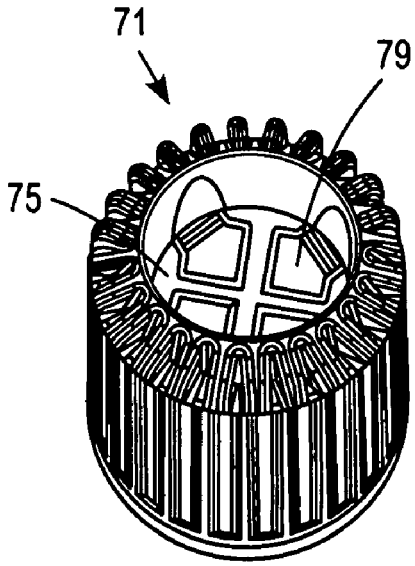
FIG. 3A is a perspective view of a pierceable cap with a foil frangible layer.
Figure 3C:
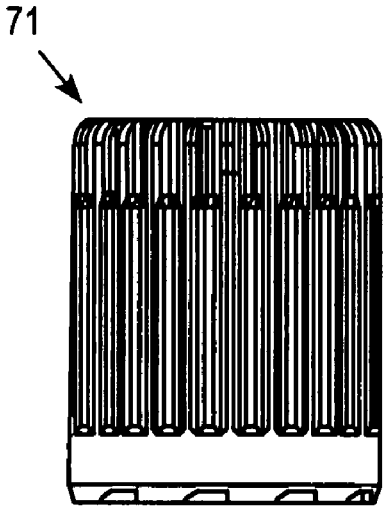
FIG. 3C is a side view of the pierceable cap of FIG. 3A.
Figure 3D:
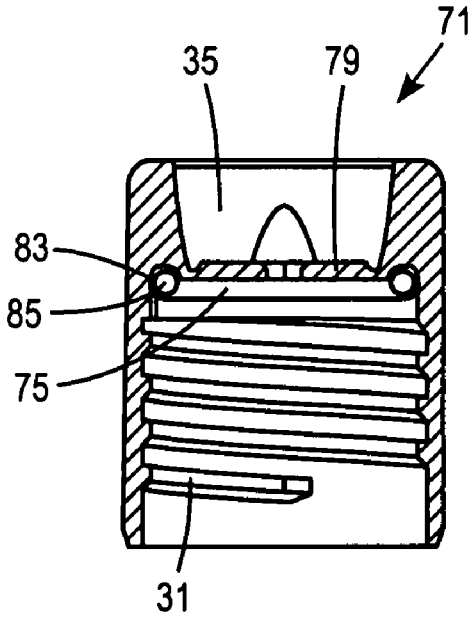
FIG. 3D is a cross sectional view of the pierceable cap of FIG. 3A.
Figure 3E:
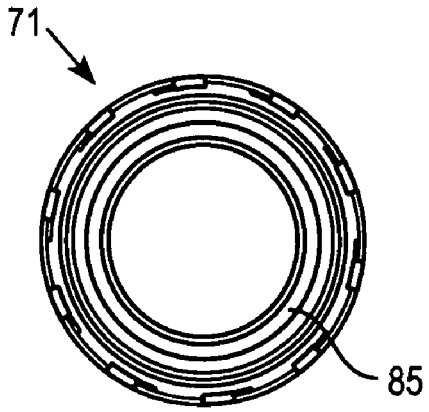
FIG. 3E is a bottom view as molded of the pierceable cap of FIG. 3A.
Figure 3F:
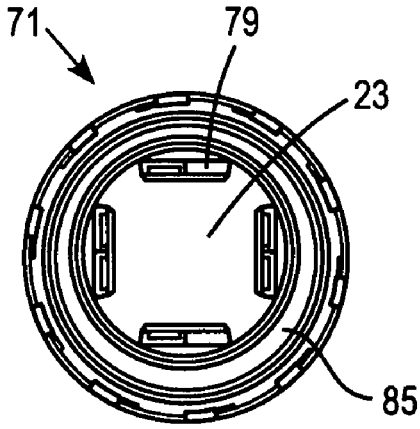
FIG. 3F is a bottom view of the pierceable cap of FIG. 3A pierced with foil not shown.
Figure 3G:
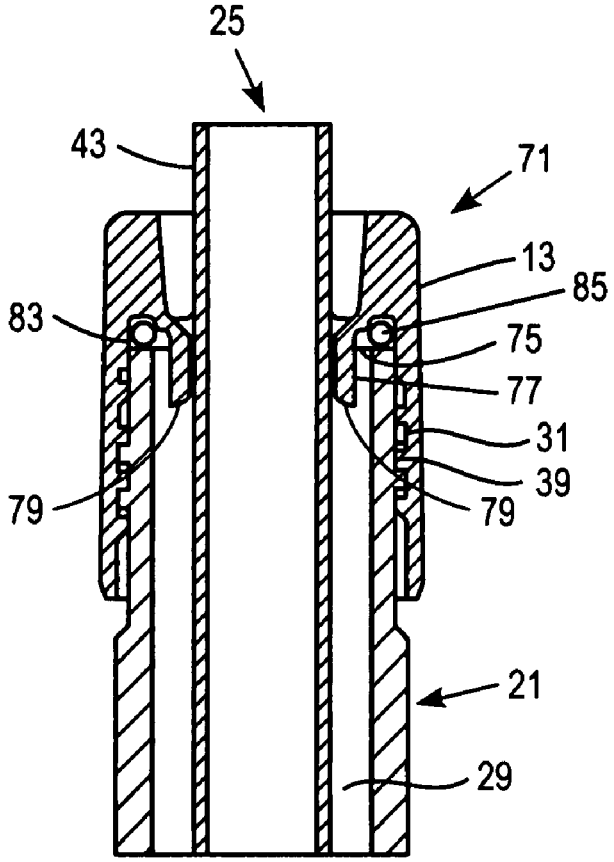
FIG. 3G is a cross sectional view of the pierceable cap of FIG. 3A coupled to a vessel with a pipette tip inserted through the cap.

The frangible layer 15 may be disposed within the access port 23 such that transfer of the sample specimen through the access port is reduced or eliminated. In FIGS. 1A-1G, the frangible layer 15 is a diaphragm. FIGS. 2A-2B, not shown to scale, are exemplary frangible layers 15 in the form of diaphragms. The frangible layer 15 is preferably made of rubber, but may be made of plastic, foil or any other suitable material. The frangible layer may also be a Mylar or metal coated Mylar fused, resting, or partially resting upon an elastic diaphragm. A diaphragm may also serve to close the access port 23 after a transfer of the sample specimen to retard evaporation of any sample specimen remaining in the vessel 21. The frangible layer 15 may be thinner in a center 57 of the frangible layer 15 or in any position closest to where a break in the frangible layer 15 is desired. The frangible layer 15 may be thicker at a rim 59 where the frangible layer 15 contacts the shell 13 and/or the optional gasket 17. Alternatively, the frangible layer 15 may be thicker at a rim 59 such that the rim 59 of the frangible layer 15 forms a functional gasket within the shell 13 without the need for the gasket 17. The frangible layer 15 is preferably symmetrical radially and top to bottom such that the frangible layer 15 may be inserted into the cap 11 with either side facing a well 29 in the vessel 21. The frangible layer 15 may also serve to close the access port 23 after use of a transfer device 25. A peripheral groove 53 may be molded into the shell 13 to secure the frangible layer 15 in the cap 11 and/or to retain the frangible layer 15 in the cap 11 when the frangible layer 15 is pierced. The peripheral groove 53 in the cap 11 may prevent the frangible layer 15 from being pushed down into the vessel 21 by a transfer device 25. One or more pre-formed scores or slits 61 may be disposed in the frangible layer 15. The one or more preformed scores or slits 61 may facilitate breaching of the frangible layer 15. The one or more preformed scores or slits 61 may be arranged radially or otherwise for facilitating a breach of the frangible layer 15.

The frangible layer 15 may be breached during insertion of a transfer device 25. Breaching of the frangible layer 15 may include piercing, tearing open or otherwise destroying the structural integrity and seal of the frangible layer 15. The frangible layer 15 may be breached by a movement of one or more extensions 27 around or along a coupling region 47 toward the well 29 in the vessel 21. The frangible layer 15 may be disposed between the one or more extensions 27 and the vessel 21 when the one or more extensions 27 are in an initial position.

In certain embodiments, the frangible layer 15 and the one or more extensions 27 may be of a unitary construction. In some embodiments, the one or more extensions 27 may be positioned in a manner to direct or realign a transfer device 25 so that the transfer device 25 may enter the vessel 21 in a precise orientation. In this manner, the transfer device 25 may be directed to the center of the well 29, down the inner side of the vessel 21 or in any other desired orientation.

In embodiments of the present invention, the one or more extensions 27 may be generated by pre-scoring a pattern, for example, a "+", in the pierceable cap 11 material. In alternative embodiments, the one or more extensions 27 may be separated by gaps. Gaps may be of various shapes, sizes and configuration depending on the desired application. In certain embodiments, the pierceable cap 11 may be coated with a metal, such as gold, through a vacuum metal discharge apparatus or by paint. In this manner, a pierced cap may be easily visualized and differentiated from a non-pierced cap by the distortion in the coating.

The one or more extensions 27 may be integrally molded with the shell 13. The one or more extensions 27 may have different configurations depending on the use. The one or more extensions 27 may be connected to the shell 13 by the one or more coupling regions 47. The one or more extensions 27 may be include points 49 facing into the center of the cap 11 or towards a desired breach point of the frangible layer 15. The one or more extensions 27 may be paired such that each leaf faces an opposing leaf. Preferred embodiments of the present invention may include four or six extensions arranged in opposing pairs. FIGS. 1A-1G show four extensions. The one or more coupling regions 47 are preferably living hinges, but may be any suitable hinge or attachment allowing the one or more extensions to move and puncture the frangible layer 15.

The access port 23 may be at least partially obstructed by the one or more extensions 27. The one or more extensions 27 may be thin and relatively flat. Alternatively, the one or more extensions 27 may be leaf-shaped. Other sizes, shapes and configurations are possible. The access port 23 may be aligned with the opening 19 of the vessel 21.

The gasket 17 may be an elastomeric ring between the frangible layer 15 and the opening 19 of the vessel 21 or the frangible layer 15 and the cap 11 for preventing leakage before the frangible layer 15 is broken. In some embodiments of the invention, the gasket 17 and the frangible layer 15 may be integrated as a single part.

A surface 33 may hold the frangible layer 15 against the gasket 17 and the vessel 21 when the cap 11 is coupled to the vessel 21. An exterior recess 35 at a top 37 of the cap 11 may be disposed to keep wet surfaces out of reach of a user's fingers during handling. Surfaces of the access portal 23 may become wet with portions of the sample specimen during transfer. The exterior recess 35 may reduce or eliminate contamination by preventing contact by the user or automated capping/de-capping instruments with the sample specimen during a transfer. The exterior recess 35 may offset the frangible layer 15 away from the top end 37 of the cap 11 towards the bottom end 38 of the cap 11.

The shell 13 may include screw threads 31 or other coupling mechanisms for joining the cap 11 to the vessel 15. Coupling mechanisms preferably frictionally hold the cap 11 over the opening 19 of the vessel 21 without leaking. The shell 13 may hold the gasket 17 and the frangible layer 15 against the vessel 21 for sealing in the sample specimen without leaking. The vessel 21 preferably has complementary threads 39 for securing and screwing the cap 11 on onto the vessel. Other coupling mechanisms may include complementary grooves and/or ridges, a snap-type arrangement, or others.

The cap 11 may initially be separate from the vessel 21 or may be shipped as coupled pairs. If the cap 11 and the vessel 21 are shipped separately, then a sample specimen may be added to the vessel 21 and the cap 11 may be screwed onto the complementary threads 39 on the vessel 21 before transport. If the cap 11 and the vessel 21 are shipped together, the cap 11 may be removed from the vessel 11 before adding a sample specimen to the vessel 21. The cap 11 may then be screwed onto the complementary threads 39 on the vessel 21 before transport. At a testing site, the vessel 21 may be placed in an automated transfer instrument without removing the cap 11. Transfer devices 25 are preferably pipettes, but may be any other device for transferring a sample specimen to and from the vessel 21. When a transfer device tip 41 enters the access port 23, the transfer device tip 41 may push the one or more extensions 27 downward towards the well 29 of the vessel 21. The movement of the one or more extensions 27 and related points 49 may break the frangible layer 15. As a full shaft 43 of the transfer device 25 enters the vessel 21 through the access port 23, the one or more extensions 27 may be pushed outward to form airways or vents 45 between the frangible layer 15 and the shaft 43 of the transfer device 25. The airways or vents 45 may allow air displaced by the tip 41 of the transfer device to exit the vessel 21. The airways or vents 45 may prevent contamination and maintain pipetting accuracy.

The action and thickness of the one or more extensions 27 may create airways or vents 45 large enough for air to exit the well 29 of the vessel 21 at a low velocity. The low velocity exiting air preferably does not expel aerosols or small drops of liquid from the vessel. The low velocity exiting air may reduce contamination of other vessels or surfaces on the pipetting instrument. In some instances, drops of the sample specimen may cling to an underside surface 51 of the cap 11. In existing systems, if the drops completely filled and blocked airways on a cap, the sample specimen could potentially form bubbles and burst or otherwise create aerosols and droplets that would be expelled from the vessel and cause contamination. In contrast, the airways and vents 45 created by the one or more extensions 27, may be large enough such that a sufficient quantity of liquid cannot accumulate and block the airways or vents 45. The large airways or vents 45 may prevent the pressurization of the vessel 21 and the creation and expulsion of aerosols or droplets. The airways or vents 45 may allow for more accurate transfer of the sample specimens.

An embodiment may include a molded plastic shell 13 to reduce costs. The shell 13 may be made of polypropylene for sample compatibility and for providing a resilient living hinge 47 for the one or more extensions 27. The cap 11 may preferably include three to six dart-shaped extensions 27 hinged at a perimeter of the access portal 23. For moldability, the portal may have a planar shut-off, 0.030" gaps between extensions 27, and a 10 degree draft. The access portal 23 may be roughly twice the diameter of the tip 41 of the transfer device 25. The diameter of the access portal 23 may be wide enough for adequate venting yet small enough that the one or more extensions 27 have space to descend into the vessel 21. The exterior recess 25 in the top of the shell 13 may be roughly half the diameter of the access portal 23 deep, which prevents any user's finger tips from touching the access portal.

FIGS. 3A-3G show an alternative embodiment of a cap 71 with a foil laminate used as a frangible layer 75. The frangible layer 75 may be heat welded or otherwise coupled to an underside 77 of one or more portal extensions 79. During insertion of a transfer device 25, the frangible layer 75 may be substantially ripped as the one or more portal extensions 79 are pushed towards the well 29 in the vessel or as tips 81 of the one or more portal extensions 79 are spread apart. The foil laminate of the frangible layer 75 may be inserted or formed into a peripheral groove 83 in the cap 71. An o-ring 85 may also be seated within the peripheral groove 83 for use as a sealing gasket. The peripheral groove 83 may retain the o-ring 85 over the opening 29 of the vessel 21 when the cap 71 is coupled to the vessel 21. The cap 71 operates similarly to the above caps.

Figure 4A:
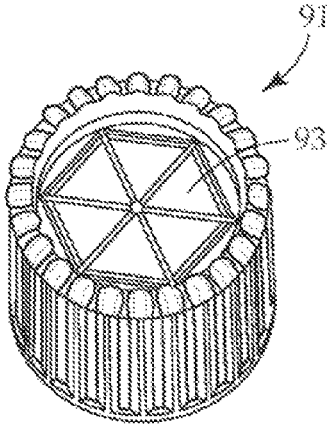
FIG. 4A is a perspective view of a pierceable cap with a liner frangible layer and extensions in a flat star pattern.
Figure 4B:
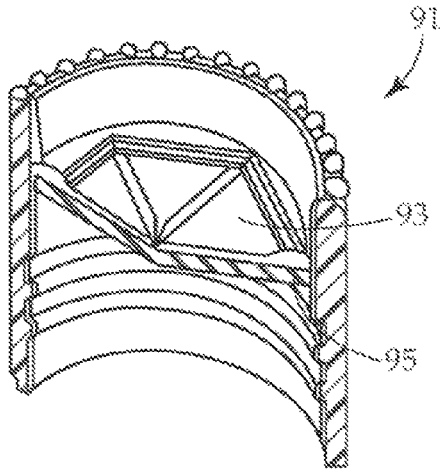
FIG. 4B is a perspective cut away view of the pierceable cap of FIG. 4A.

FIGS. 4A-4B show an alternative cap 91 with an elastomeric sheet material as a frangible layer 95. The frangible layer 95 may be made of easy-tear silicone, such as a silicone sponge rubber with low tear strength, hydrophobic Teflon, or other similar materials. The frangible layer 95 may be secured adjacent to or adhered to the cap 91 for preventing unwanted movement of the frangible layer 95 during transfer of the sample specimen. The elastomeric material may function as a vessel gasket and as the frangible layer 95 in the area of a breach. One or more extensions 93 may breach the frangible layer 95. The cap 91 operates similarly to the above caps.

Figure 5A:
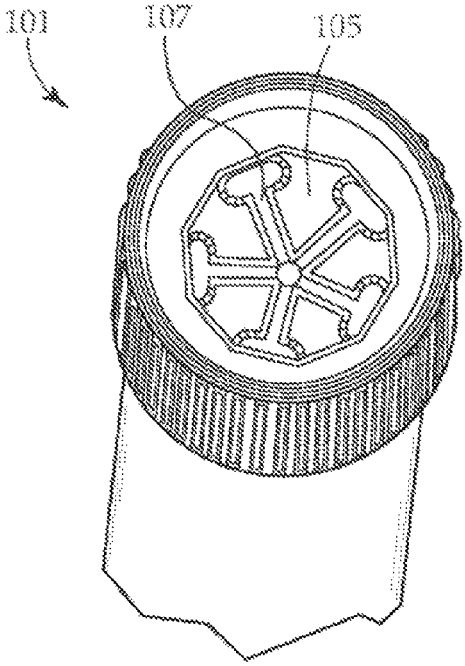
FIG. 5A is a perspective view of a pierceable cap with a conical molded frangible layer and extensions in a flat star pattern.
Figure 5B:
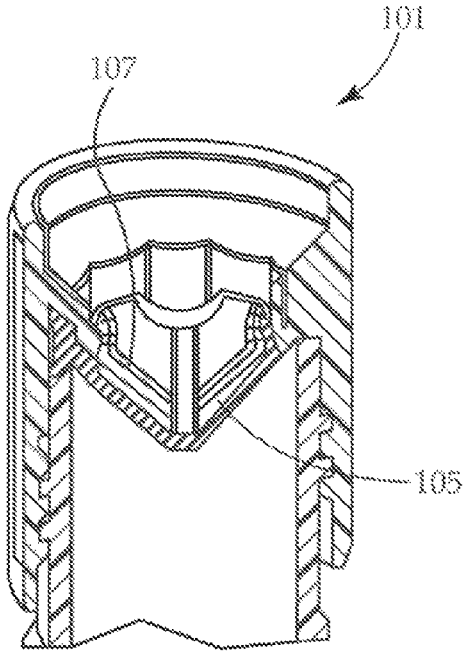
FIG. 5B is a perspective cut away view of the pierceable cap of FIG. 5A.

FIGS. 5A-5B show an alternative cap 101 with a conical molded frangible layer 105 covered by multiple extensions 107. The cap 101 operates similarly to the above caps.

Embodiments of the present invention can utilize relatively stiff extensions in combination with relatively fragile frangible layers. Either the frangible layer and/or the stiff extensions can be scored or cut; however, embodiments where neither is scored or cut are also contemplated. Frangible materials by themselves may not normally open any wider than a diameter of the one or more piercing elements. In many situations, the frangible material may remain closely in contact with a shaft of a transfer device. This arrangement may provide inadequate venting for displaced air. Without adequate airways or vents a transferred volume may be inaccurate and bubbling and spitting of the tube contents may occur. Stiff components used alone to seal against leakage can be hard to pierce, even where stress lines and thin wall sections are employed to aid piercing. This problem can often be overcome, but requires additional costs in terms of quality control. Stiff components may be cut or scored to promote piercing, but the cutting and scoring may cause leakage. Materials that are hard to pierce may result in bent tips on transfer devices and/or no transfer at all. Combining a frangible component with a stiff yet moveable component may provide both a readily breakable seal and adequate airways or vents to allow accurate transfer of a sample specimen without contamination. In addition, in some embodiments, scoring of the frangible layer will not align with the scoring of the still components. This can most easily be forced by providing a frangible layer and stiff components that are self aligning.

Furthermore, changing the motion profile of the tip of the transfer device during penetration may reduce the likelihood of contamination. Possible changes in the motion profile include a slow pierce speed to reduce the speed of venting air. Alternative changes may include aspirating with the pipettor or similar device during the initial pierce to draw liquid into the tip of the transfer device.

Although the foregoing description is directed to the preferred embodiments of the invention, it is noted that other variations and modifications will be apparent to those skilled in the art, and may be made without departing from the spirit or scope of the invention. Moreover, features described in connection with one embodiment of the invention may be used in conjunction with other embodiments, even if not explicitly stated above.

The invention claimed is:

1. A pierceable cap comprising:

a shell, an access port in the shell for allowing passage of at least part of a transfer device through the access port, wherein the transfer device transfers a sample specimen, a frangible layer disposed across the access port for preventing transfer of the sample specimen through the access port prior to insertion of the at least part of the transfer device, a peripheral groove for securing the frangible layer within the shell, one or more extensions proximate to the frangible layer, wherein the one or more extensions are coupled to the shell at one or more coupling regions, and wherein the one or more extensions rotate around the one or more coupling regions and pierce the frangible layer upon application of pressure from the transfer device.

2. The pierceable cap of claim 1, wherein the pierceable cap is coupled to a vessel.

3. The pierceable cap of claim 2, wherein the pierceable cap is coupled to the vessel by complementary screw threads.

4. The pierceable cap of claim 2, wherein the pierceable cap is coupled to the vessel by complementary ridges and grooves.

5. The pierceable cap of claim 1, wherein the one or more coupling regions are one or more living hinge regions.

6. The pierceable cap of claim 1, wherein the pierceable cap is coated for visually indicating whether the cap is pierced or not pierced.

7. The pierceable cap of claim 1, wherein the frangible layer is a diaphragm.

8. The pierceable cap of claim 7, wherein the diaphragm is thinner closest to the location of the piercing.

9. The pierceable cap of claim 7, wherein the diaphragm is thickest at an outer perimeter for creating a gasket at the outer perimeter.

10. The pierceable cap of claim 7, wherein the diaphragm is symmetrical radially and top to bottom.

11. The pierceable cap of claim 1, wherein the frangible layer is foil.

12. The pierceable cap of claim 11, wherein the foil is secured to the cap.

13. The pierceable cap of claim 11, further comprising an o-ring for sealing the pierceable cap to a vessel.

14. The pierceable cap of claim 1, wherein the shape of the frangible layer is conical and forms a point, wherein the point faces the base of the shell.

15. The pierceable cap of claim 14, wherein the one or more extensions are initially disposed in a conical configuration complementary to the frangible layer.

16. The pierceable cap of claim 1, wherein the frangible layer and the one or more extensions are unitary in construction.

17. The pierceable cap of claim 1, wherein the frangible layer further comprises pre-formed scoring.

18. The pierceable cap of claim 1, wherein the frangible layer is permeable to gases.

19. The pierceable cap of claim 1, wherein the frangible layer has low gas permeability.

20. The pierceable cap of claim 1, further comprising an exterior recess within the access port and between a top of the shell and the one or more extensions.

21. The pierceable cap of claim 1, further comprising a gasket for securing the frangible layer within the shell and creating a seal between the pierceable cap and a vessel.

22. The pierceable cap of claim 1, further comprising more than one extension arranged in a star pattern.

23. The pierceable cap of claim 1, wherein the one or more extensions are arranged in opposing pairs.

24. The pierceable cap of claim 1, wherein the one or more extensions each have a pointed end opposite the one or more coupling regions.

25. The pierceable cap of claim 1, wherein the one or more extensions are formed from pre-formed scoring in the pierceable cap.

26. The pierceable cap of claim 1, wherein the one or more extensions are positioned for directing the at least part of the transfer device to a desired position within a vessel.

27. The pierceable cap of claim 1, wherein the movement of the one or more extensions creates airways for allowing air to move through the access port.

28. A pierceable cap comprising:

a shell, an access port through the shell, one or more extensions having a proximate end coupled to walls of the access port by one or more coupling regions and a distal end extending into the access port, wherein the distal end of the extensions are movable, in response to pressure from a transfer device disposed in the access port, from a first position to a second position, a frangible layer within the access port proximate to the one or more extensions, wherein the distal end of the extensions, in the second position, pierce the frangible layer, wherein the frangible layer comprises pre-formed scoring.

29. A pierceable cap comprising:

a shell, an access port in the shell for allowing passage of at least part of a transfer device through the access port, wherein the transfer device transfers a sample specimen, a frangible layer disposed across the access port for preventing transfer of the sample specimen through the access port prior to insertion of the at least part of the transfer device, wherein the frangible layer further comprises pre-formed scoring, one or more extensions proximate to the frangible layer, wherein the one or more extensions are coupled to the shell at one or more coupling regions, and wherein the one or more extensions rotate around the one or more coupling regions and pierce the frangible layer upon application of pressure from the transfer device.

* * * * *